US005644986A

United States Patent [19]

Gydesen

[11] Patent Number: 5,644,986

[45] Date of Patent: Jul. 8, 1997

[54] METHOD AND APPARATUS FOR CLEANING A ROLLER SURFACE

[75] Inventor: Erik Gydesen, Vejle, Denmark

[73] Assignee: Maskinfabriken Tresu A/S, Denmark

[21] Appl. No.: 571,824

[22] PCT Filed: Jul. 6, 1994

[86] PCT No.: PCT/DK94/00276

§ 371 Date: Feb. 6, 1996

§ 102(e) Date: Feb. 6, 1996

[87] PCT Pub. No.: WO95/01876

PCT Pub. Date: Jan. 19, 1995

[30] Foreign Application Priority Data

Jul. 9, 1993 [DK] Denmark ..... 831/93

[51] Int. Cl.[6] ..... B41F 35/00

[52] U.S. Cl. ..... 101/424; 101/425

[58] Field of Search ..... 101/424, 423, 101/425; 15/256.51

[56] References Cited

FOREIGN PATENT DOCUMENTS

| | | |
|---|---|---|
| 0369565 | 5/1990 | European Pat. Off. . |
| 63-4947 | 1/1988 | Japan . |
| 9412349 | 6/1994 | WIPO . |

*Primary Examiner*—John S. Hilten
*Assistant Examiner*—Anthony H. Nguyen
*Attorney, Agent, or Firm*—Ladas & Parry

[57] ABSTRACT

Disclosed is a method and apparatus for cleaning a cylinder surface. The method is particularly suitable for use on flexographic printing cylinders where the automatic cleaning apparatus facilitates the cleaning of plate cylinders or on any type of cylinders. The method comprises detaching particles such as dust, fibers and other foreign objects deposited on the cylinder surface by means of pressurized fluid of air, liquid, ultrasound or other suitable media. After the particles have been detached, the cylinder surface is exposed to a vacuum unit whereby the detached particles and other material deriving from the cleaning medium are sucked off the surface of the cylinder. The advantage is that, in many cases, it will not be necessary to halt the printing process for cleaning the cylinder. The apparatus comprises a cleaning head or pipes capable of providing the pressurized fluid to the cylinder surface and removing any particles detached from the cylinder surface while the cylinder is in normal operation.

12 Claims, 5 Drawing Sheets

FIG. 6A
FIG. 6
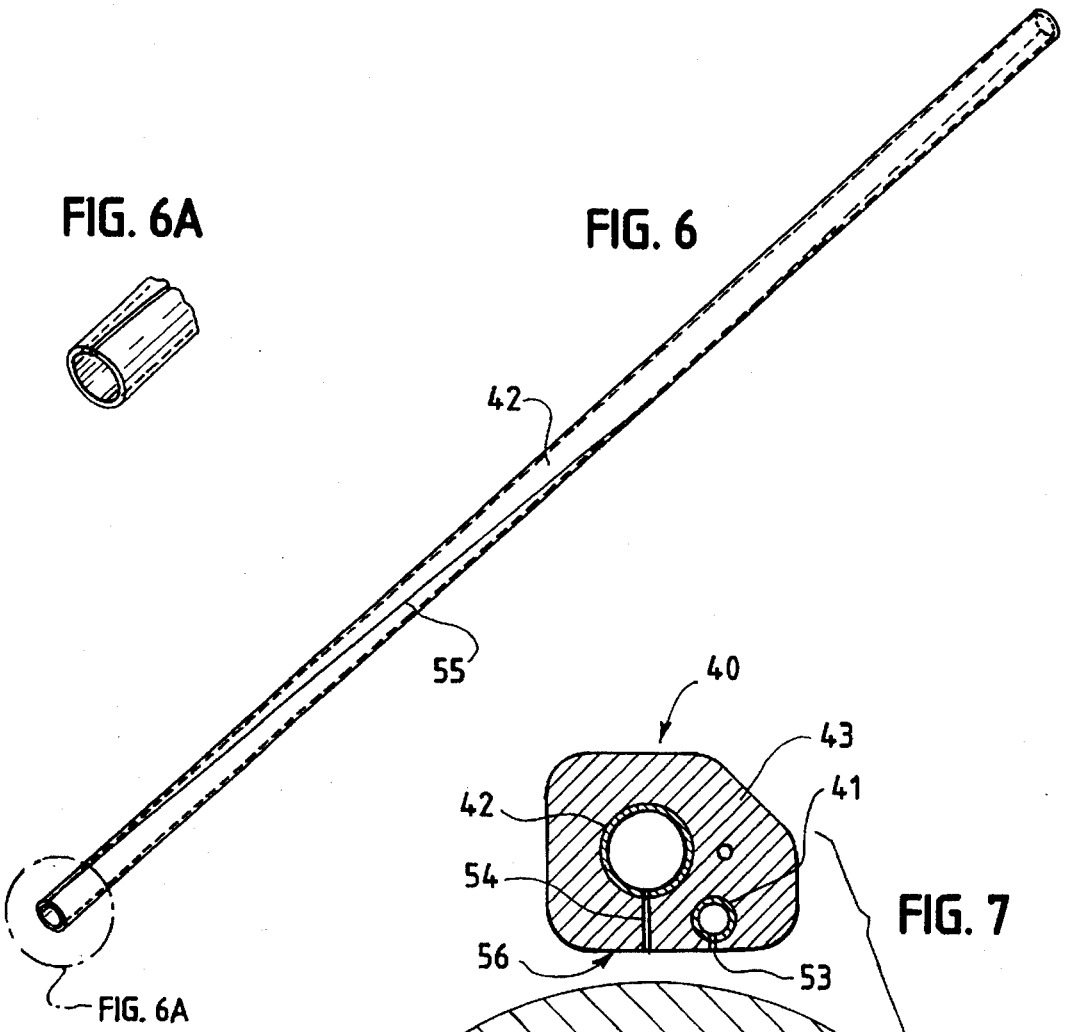
FIG. 7
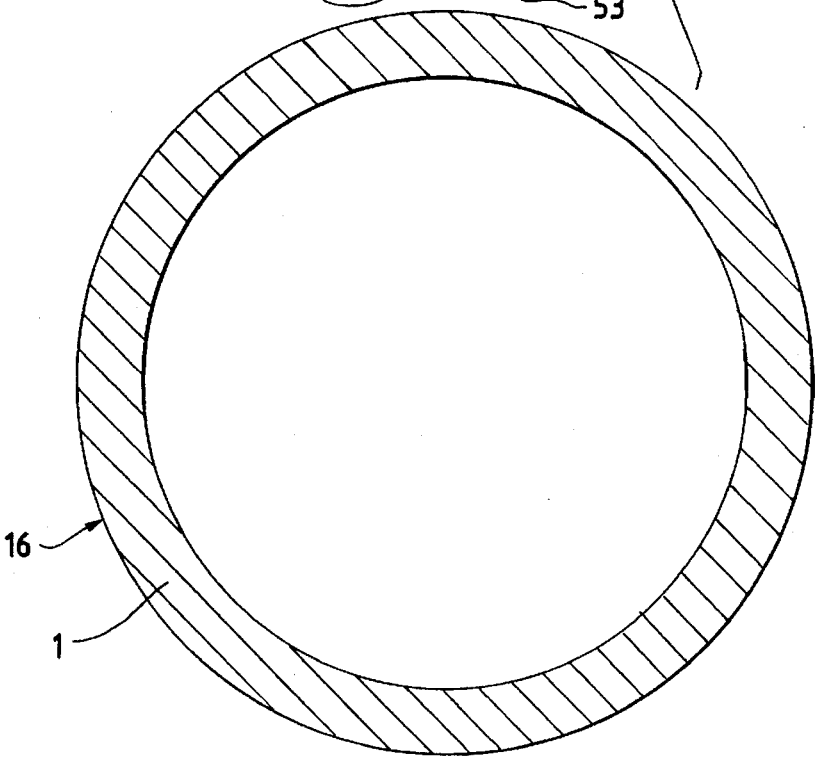

METHOD AND APPARATUS FOR CLEANING A ROLLER SURFACE

BACKGROUND OF THE INVENTION

The present invention relates to a method for automatic cleaning of a cylinder, especially a cylinder of a printing machine, in which the cylinder is provided with plates and used for printing on a print carrier made of e.g. paper, plastic film, or metal film, and in which the cylinders become smudged, during printing, with printing ink, particles detached from said print carrier such as dust or fibres, and other foreign objects, wherein an area of the cylinder surface is cleaned by exposing said area to a pressurized flow of fluid so that the foreign objects inside the area on the cylinder surface are detached, and wherein said area is exposed to a vacuum to remove said detached foreign objects and any other material originating from said flow of fluid.

So-called flexographic printing on a print carrier of paper, plastic film or metal film uses a system consisting of a first cylinder, around which a web of the print carrier runs, a second cylinder performing the actual printing and being provided with plates for this purpose, and a third cylinder transmitting ink to the second cylinder.

When the printing process has continued for a certain time, there will normally arise problems with the printing quality. This is because the second cylinder, the printing cylinder, has become smudged with dust, fibres or other particles from the web of paper, plastic film or metal film. When this occurs, it is necessary to halt the printing process, displace the cylinder from its bearing and then manually brush or wash impurities off the second cylinder. This is a serious inconvenience since it means that the stoppage periods may amount to as much as 30 per cent of the total time in which the machine is in use. This means that the operation time in which printing takes place may risk being reduced to 70 per cent of the time in which the machine is in use. Out of those 30 per cent of time in which the machine is halted, up to 90 per cent is due to cleaning the printing cylinder. Furthermore, the waste of paper, plastic film or metal film is substantial because there is a certain running-in period after a stoppage and the web of paper or film being printed during this period does not have a sufficient quality and must be discarded.

EP-0,369,565 describes a cleaner for automatic cleaning of a cylinder by pressing or otherwise discarding impurities from the surface of the cylinder. The cylinder cleaner comprises a brush extending along the total length of the cylinder or, in another embodiment, a bar for applying pressurized air or ultrasound. The cleaning takes place by rotating or displacing the brush along the entire length of the cylinder or by applying pressurized air or ultrasound along the entire length of the bar. This cleaner, however, has the great inconvenience that the efficiency of the cleaning is strongly reduced. Firstly, cleaning by using a brush quickly results in the brush being worn up together with the surface of the cylinder being worn. Secondly, cleaning by using pressurized air or ultrasound being applied to the total length of the cylinder has the effect that the efficiency of the cleaning is not the same over the total length of the cylinder. The pressurized air or the ultrasound is applied at one end of the bar and, therefore, the efficiency of the cleaning will be highest at the first end of the bar and lowest at a second end of the bar opposite the end at which the pressurized air or the ultrasound is applied.

WO 94/12349, a document published after the priority of the present invention, describes an apparatus also for cleaning the surface of a cylinder. The apparatus comprises a jet nozzle being located inside a suction nozzle. The jet nozzle emits a single jet of liquid, and the liquid together with impuries detached from the surface of the cylinder are evacuated through the suction nozzle. The jet nozzle is arranged in the centre of the suction nozzle, and at the opening of the suction nozzle a means for supplying compressed air into the chamber of the suction nozzle is also provided. This apparatus has the inconvenience of using a jet of liquid for cleaning the surface of the cylinder. After cleaning, it will be necessary to wait until the surface is completely dry before further printing can take place. However, an even more serious inconvenience of the apparatus is that only one jet nozzle is provided. Due to this effect the cleaning process will take a large amount of time because the single and relatively small jet of liquid has to be displaced along the entire length of the roller in order to clean the whole surface of the roller. This displacement, therefore, has to take place very slowly in order to ensure cleaning of the whole surface.

JP 63-4947 describes af further apparatus for cleaning the surface of a roller in a typographic rotary press. This apparatus comprises a jet nozzle for supplying a jet of pressurized air, contrary to liquid, and also a vacuum duct for evacuating the impurities detached from the surface of the roller. Like in the previous publications, the jet nozzle is located inside in the vacuum duct. Although using pressurized air, this apparatus also has the great inconvenience of having only one jet nozzle for supplying the pressurized air. Like before, the jet nozzle has to be displaced along the length of the roller very slowly in order to ensure that the whole surface of the roller is cleaned. Therefore, the cleaning process when using the apparatus described in that publication will also take a very large mount of time.

Thus, it is the object of the present invention to provide a method which may be carded out automatically, and in which the above-mentioned inconveniences, such as unsuitable, cleaning media and very long time for carrying out the cleaning process, are avoided.

This object is achieved by a method characterized in that the cylinder surface is constituted by adjacent areas lengthwise and crosswise on the cylinder surface provided by such area extending over a minor part of the circumference of said cylinder and a minor part of the length of said cylinder, and that said adjacent areas of said cylinder surface are cleaned successively, wherein the pressurized fluid is provided by mixing pressurized air and a liquid in a mixing chamber, and that the so-formed mixture is led to the print plate through nozzles being connected with the mixing chamber.

In addition, apparatuses for use by the method will be disclosed.

By the method according to the present invention it is now possible, during operation, to clean a cylinder, particularly a flexographic printing cylinder. In this manner one avoids the substantial time waste previously associated with cleaning the cylinder. Reducing the time waste, one also reduces the waste of material accordingly as cleaning is accomplished during ordinary operational conditions. If cylinder cleaning is carried out before it is so smudged as to deteriorate the printing quality, there will be neither material nor time waste during cleaning.

By using several nozzles or a slot, the area around the length of the cylinder is extended as compared to using only one nozzle. Thereby the amount of time used for cleaning the surface is strongly reduced. A larger area, although still just a small area of the surface, is cleaned and accordingly, an orifice with a cleaning can be displaced along the length of the roller at a much higher speed. As mentioned before, it is very important to reduce the amount of time used during the cleaning process.

The method is advantageous in that cleaning is performed automatically and preferably while the printing process is running.

As pressurized air containing the admixed liquid is used for detaching the particles from the printing cylinder it is possible to obtain a secure and effective cleaning even if ink and dust stick very hard to the printing cylinder. This will not be possible with the liquid jets nor with the air jets. Surprisingly, and in contradiction to the expectation for the skilled in this art it has shown that is is possible to use such mixture in a cleaning process while the printing process is running. It has shown that the cleaning will not harm the quality of the printing even though it is not a dry cleaning as explained in the JP 63-4947. It is believed that the reason for the effective cleaning is that a mist is produced, which mist is led to the printing cylinder. Such mist may be sucked away very effective in comparison with a liquid even if rather limited level of vakuum is used.

For various reasons, however, it may be advantageous to use other media, e.g. depending on the ink used for printing, the material being printed on, the kind of particles to detach from the cylinder, or the speed at which the printing process is operating. Among other options for cleaning media besides a mixture of pressurized air and liquids, there could be mentioned a media influenced by an ultrasound field, and likewise various kinds of solid matter particles may be added to the fluid media constituting a fluidized medium.

Having become detached from the cylinder surface, the particles will normally have to be removed from the surface. This is accomplished in that, after the particles have been detached from the surface, the cylinder is exposed to a vacuum sucking the particles off the surface. Any other material originating from the cleaning process, e.g. solid matter particles which have been used in the cleaning process, may be sucked off at the same time. It will also be possible to load the particles that are to be detached, or have become detached, with static electricity and subsequently to use an electric voltage field to remove the particles from the cylinder surface.

In order to ensure that the cylinder with the plates is cleaned both on and between the plates, the cleaning medium should preferably be directed in an inclined angle in relation to the tangent of the cylinder surface. This will ensure that particles depositing on the sides of the plates are removed as well. Thus, the inclined flow will attack both the cylinder surface and the cylinder sides in an inclined angle, not parallel or perpendicular. The method is further advantageous in that no damage is done to the plates during the cleaning process.

As mentioned, the method is suitable for cleaning printing cylinders in flexography which printing process uses cylinders with printing plates. However, the method may be used for many types of rollers and cylinders, not just printing cylinders.

Apparatuses for use by the method according to the present invention may be designed in many different ways. Two types of apparatuses are disclosed according to the present invention. One apparatus comprises mobile cleaning members in the shape of a cleaning head being slid over the cylinder surface whereby successive cleaning of the surface takes place. The other apparatus comprises fixed cleaning members provided with an internal device likewise conducting a successive surface cleaning. It is a common feature that an antechamber is provided for effecting a mixing of liquid and a pressurized air.

DESCRIPTION OF THE DRAWINGS

The invention will now be described in further detail with reference to the attached drawings, in which FIG. 6 shows a suction pipe constituting part of the second embodiment of an apparatus, and FIG. 7 shows a cross section of a pipe member in the second embodiment according to the invention.

FIG. 1 illustrates part of a machine for flexographic printing, which machine is provided with an apparatus according to the invention. The machine comprises a cylinder 1 with plates 2. The cylinder 1 rotates around a shaft 3. The apparatus comprises a boom 4 on which a cleaning head 5 is conveyed. Conveyance is effected by means of a band 6 driven by a motor 7 such as a pneumatic motor, a hydraulic motor or other type of motor. The motor 7 is located at one end 8 of the boom 4, and the band 6 is led over a pulley 9 in the other end 10 of said boom. The cleaning head 5 is fixed to the hand 6 by means of a slide 11 which is movable relative to the boom 4. The cleaning head 5 is mounted on said slide, and the cleaning head is provided with three tubes 12, 13, 14 connected thereto. The thin tubes 11, 12 are used for conveying compressed air from an external pressure source, and liquid is fed to the cleaning head 5 through an antechamber or mixing chamber 15 wherein mixing of compressed air and liquid takes place. The thick tube 14 is used, during exposure of the cylinder surface 16 to a vacuum from an external vacuum source, to remove loosened particles and other material from the cylinder surface.

Figure 1:
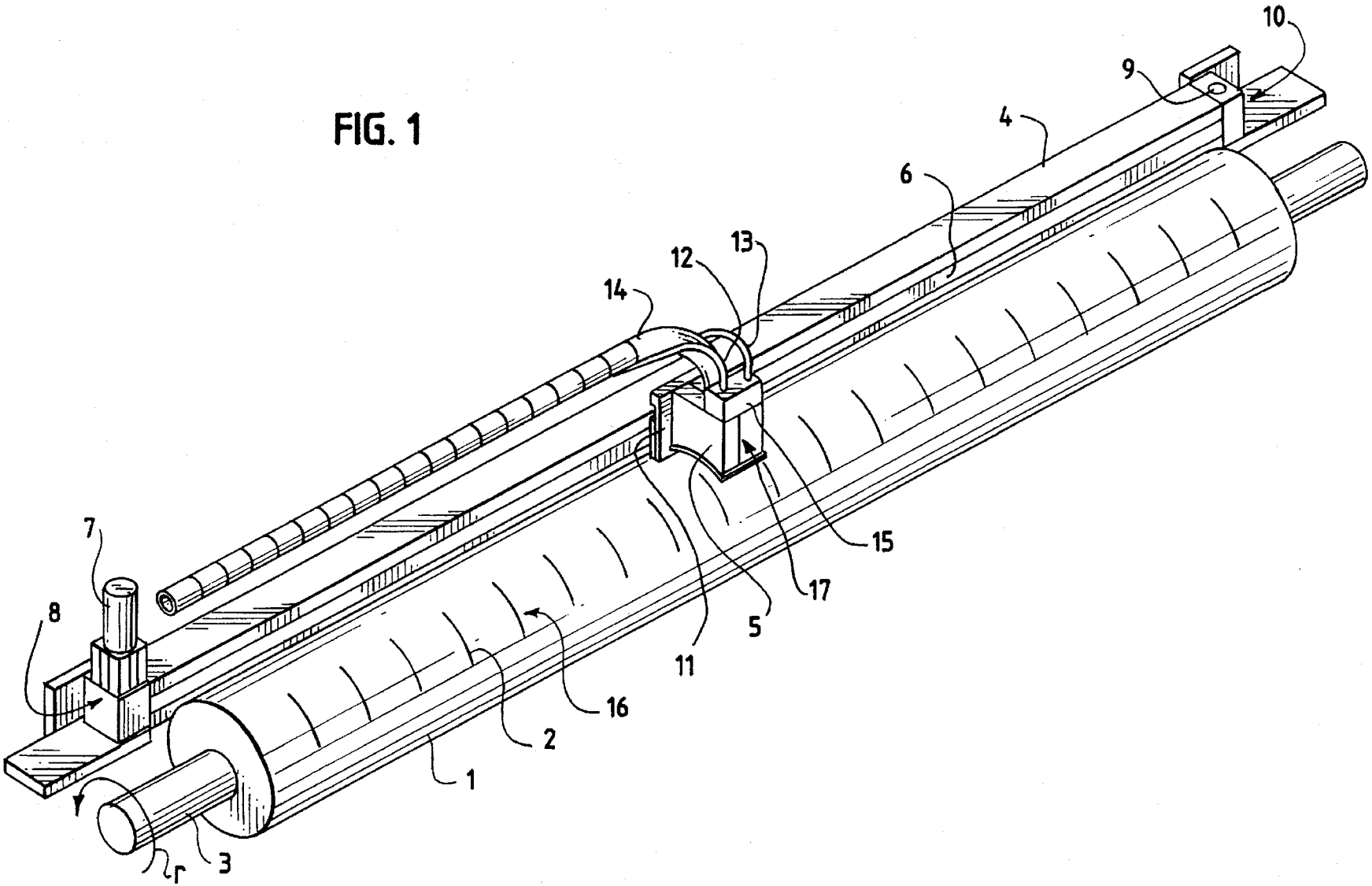
FIG. 1 shows a first embodiment of an apparatus according to the invention and for use by the method according to the invention.

In order to secure sufficient cleaning of the cylinder surface 16, the cleaning head 5 is provided with small nozzles through which the compressed air and the liquid, possibly containing fluidized particles of solid matter, are conveyed to the surface. The direction of cylinder rotation r will preferably be oriented in such a manner that the surface areas to be cleaned are led towards the cleaning head front 17, which is opposite the side of the cleaning head 5 mounted on the slide 11. By this arrangement cleaning is effected by means of a combination of one or more of the elements air, liquid and solid matter particles, immediately succeeded by the application of a vacuum to the cylinder surface. The whole cylinder is cleaned as the cleaning head 5 is moved back and forth along the boom 4 while the cylinder 1 is rotating.

Figure 2:
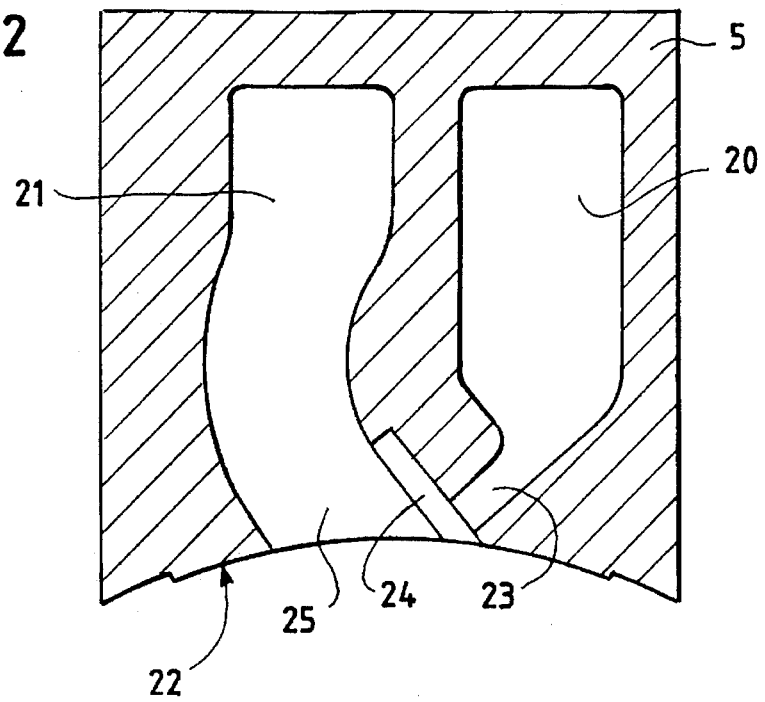
FIG. 2 shows a cleaning head forming part of the first embodiment of an apparatus.

FIG. 2 illustrates a cross-section through a cleaning head 5. The cleaning head 5 comprises two chambers 20, 21, the first chamber 20 of which is connected to the antechamber 15 (see FIG. 1), and the second chamber 21 is connected to the thick tube for vacuum application. The underside 22 of the cleaning head 5 constitutes a segment of a circle and when mounted it is immediately adjacent the cylinder surface. An orifice 23 of the first chamber is inclined in relation to the periphery of the cleaning head underside 22. This ensures improved cleaning of the cylinder surface 16. In preferred embodiments, the orifice 23 of the first chamber will be provided with screens which are provided with nozzles or slots, which may have different sizes and different directions (see FIGS. 3A–3C and 3D–3F). For mounting of the screens, the cleaning head is provided with a recess 24 before the orifice 23 of the fast chamber 20. The second chamber 21 is provided with an orifice 25 having an extension that ensures that all material from the cylinder surface 16 will be removed.

Figure 3D:
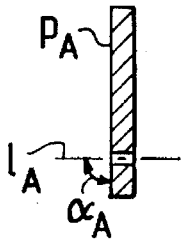
FIGS. 3D, 3E and 3F show center cross sections of the plates in FIGS. 3A, 3B and 3C, respectively.
Figure 3A:
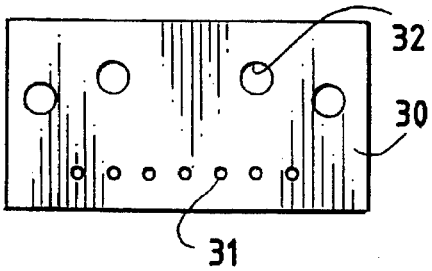
FIGS. 3A, 3B and 3C show different embodiments of masking plates for mounting in the cleaning head of the first embodiment.
Figure 3E:
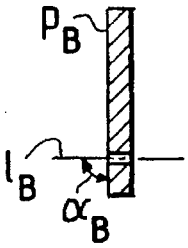
Figure 3B:
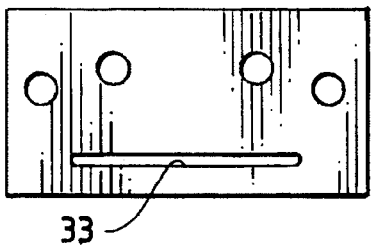
Figure 3F:
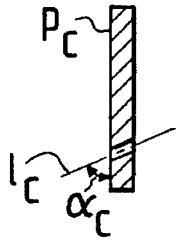
Figure 3C:
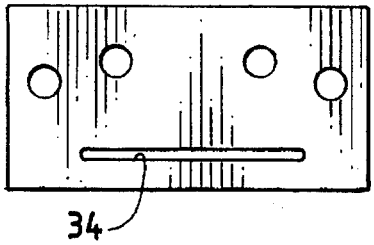

FIGS. 3A, 3B and 3C illustrate different embodiments of screens 30. FIG. 3A shows a screen 30 provided with several small holes 31 the longitudinal axis $1_A$ of which is directed (FIG. 3D) in a 90° angle $\alpha_A$ in relation to the plane $p_A$ of the screen. By this arrangement the cleaning jet is oriented in the same direction compared to the cylinder surface as the inclined direction of the orifice 23 of the first chamber 20. The screen is further provided with bolt holes 32 so that the screen may be affixed to the cleaning head 5. FIG. 3B shows a second screen provided with a slot 33 instead of holes. The slot is also inclined (FIG. 3E) in a 90° angle $\alpha_B$ in relation to the plane $p_B$ of the screen. FIG. 3C shows an additional semen, likewise provided with a slot 34. However, the slot 34 of this embodiment is directed (FIG. 3F) in a 75° angle $\alpha_c$ in relation to the plane $p_c$ of the screen. By this arrangement the direction of the jet conveyed through the slot 34 will be deflected and have a direction towards the cylinder surface 16 differing from that of the orifice 23 of the first chamber 20. As will become apparent, it is possible by means of different types of screens to change the flow pattern and flow direction of the cleaning fluid conveyed onto the cylinder surface.

Figure 4:
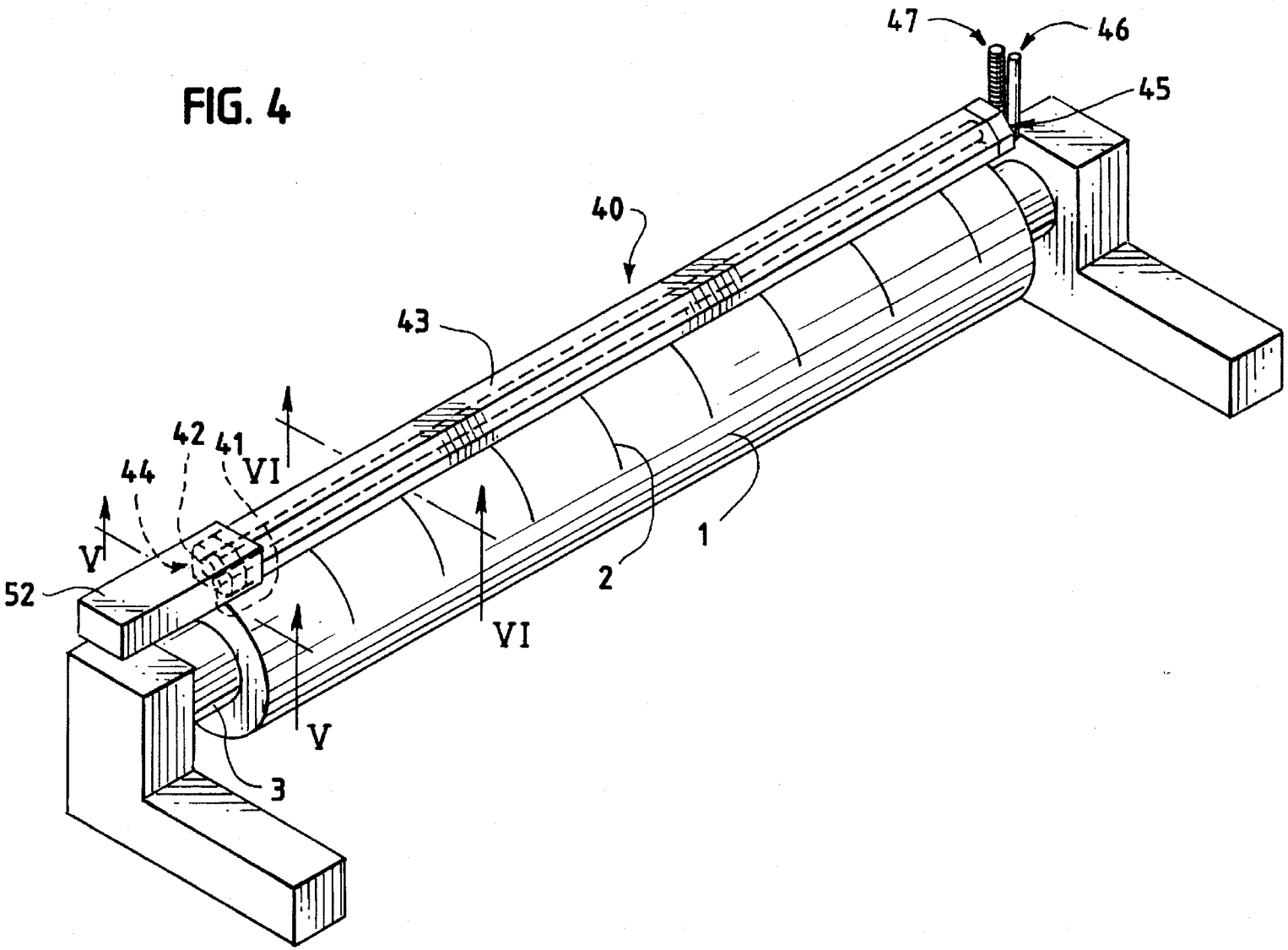
FIG. 4 shows a second embodiment of an apparatus according to the invention.

FIG. 4 illustrates part of a machine provided with a second embodiment of an apparatus according to the invention for use by the method according to tho invention. Like the machine illustrated in FIG. 1, said machine is a machine for flexographic printing. Thus, the machine comprises a cylinder 1 provided with plates 2, said cylinder being supported by a shaft 3. Positioned alongside the cylinder is a pipe member 40. The pipe member 40 comprises two pipes, a nozzle pipe 41 and a suction pipe 42, respectively, and a jacket 43. The pipes 41, 42 are supported in both ends, a first end 44 and a second end 45, respectively. The second end 45 of either pipe is open and connected with compressed air and liquid pipes 46, 47 and, respectively, a suction pipe 48 for the application of a vacuum from an external vacuum source to the suction pipe 42.

Figure 5:
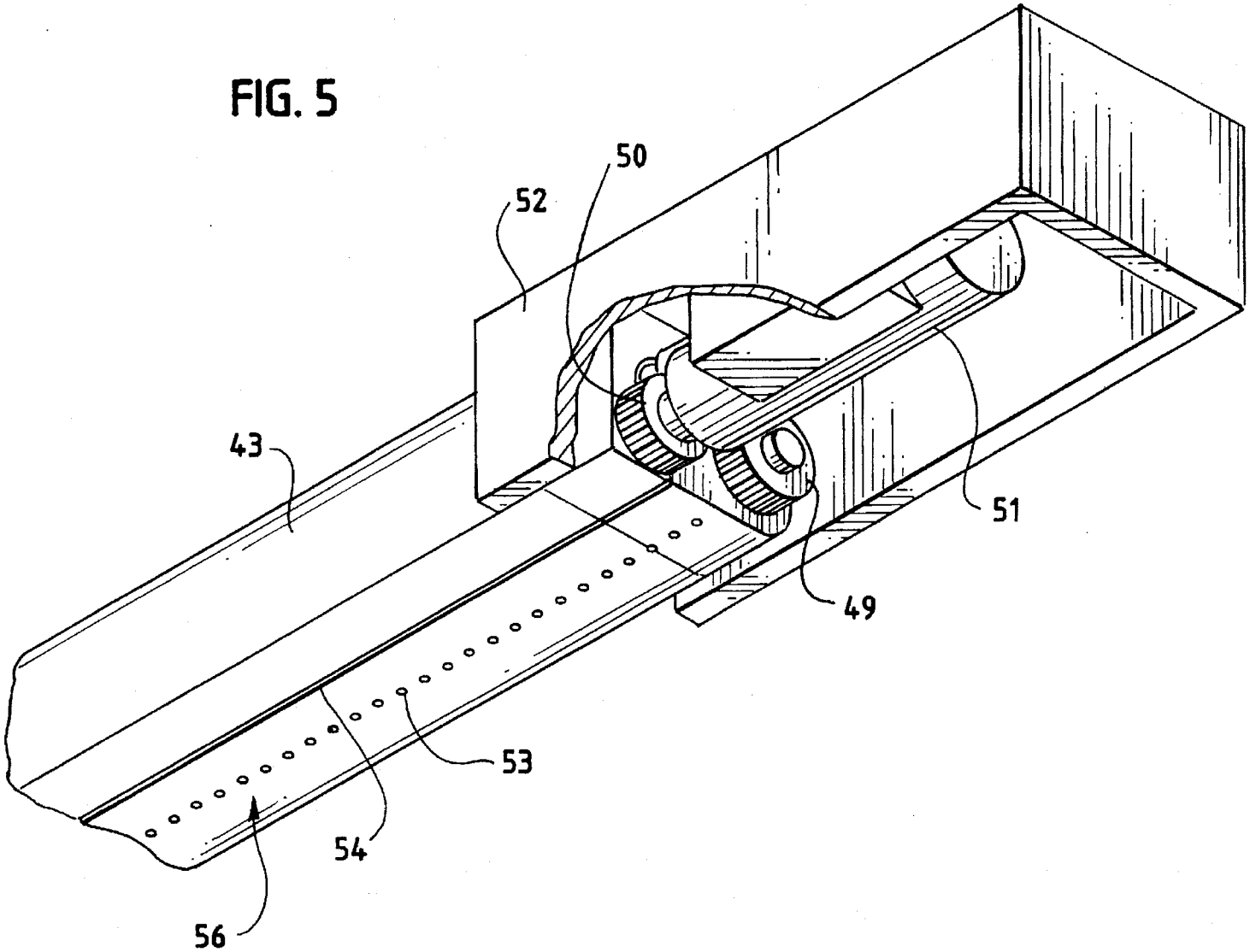
FIG. 5 shows an operating mechanism for nozzle pipes and suction pipes in the second embodiment of the apparatus according to the invention.

FIG. 5 shows that the first end 44 of either pipe 41, 42 is closed and that the pipes are interconnected by means of a gear comprising two gear wheels 49, 50 so that the pipes are rotatable around the longitudinal axes at a given mutual speed of rotation. A motor 51, such as a pneumatic motor, a hydraulic motor or other type of motor, is connected to the suction pipe 42. The motor drives the suction pipe 42, which drives the nozzle pipe 41 via the gear transmission with the latter. The motor 51 and the gear are sheltered by a box 52. The figure illustrates the first end 44 of the pipe member 40 seen from a side 56 facing the cylinder. On this side, the jacket 43 of the pipe member 40 is provided with nozzles 53 and a slot 54. The nozzles 53 are in connection with the outside surface of the nozzle pipe 41, whereas the slot 54 is in connection with the outside surface of the suction pipe 42.

FIG. 6 illustrates the nozzle pipe 41 or, alternatively, the suction pipe 42. A preferred embodiment of either one of the nozzle pipe and the suction pipe is provided with a slot 55 spiraling along the length of either pipe. The slot 55 extends in such a manner that the spiral completes exactly one turn over the extension of the slot from one end of either pipe to the other. In an alternative embodiment, one or both of the pipes are just provided with a rectilinear slot. The function of the two pipes will be described below.

FIG. 7 is a cross-section illustrating the position of the nozzle pipe 41 and the suction pipe 42 relative to each other inside the pipe member 40. Besides the two pipes 41, 42 the pipe member comprises, as mentioned, a jacket 43 enclosing the two pipes which are thus positioned in two cavities in the jacket. As an alternative to the jacket, the nozzle and suction pipes may be enclosed in the hollow space formed by the inside of additional pipes having an inside diameter corresponding to the outside diameter of the nozzle pipe and the suction pipe, respectively. In that case, these additional pipes would be provided with nozzles 53 and a slot 54 corresponding to the ones provided in the jacket.

The nozzles 53 and the slot 54 in the jacket 43 extend from one side 56 of the pipe member 40, facing the cylinder 1, to the nozzle pipe 41 and the suction pipe 42, respectively. In use, the nozzle pipe 41 will be connected to a source of compressed air and possibly also a source of liquid which may contain fluidized particles of solid matter. As an alternative to the compressed air source, the nozzle pipe 41 may be connected to an ultrasound source which effects a cleaning of the cylinder surface 16 by means of the liquid.

The combination of compressed air, liquid and possibly ultrasound conveyed to the nozzle pipe 41 will, during rotation of the latter, be conveyed out though the nozzles 53 in the jacket 43 every time the slot in the nozzle pipe 41 (see FIG. 6) is aligned with the nozzles of the jacket. This way of effecting a step-by-step application of cleaning medium to the cylinder surface reduces the risk of excessive pressure reduction occurring over the extension of the pipe. Since only a minor part of the total extension of the screw-shaped slot in the nozzle pipe 41 overlaps the nozzles 53 in the jacket 43, a uniform pressure will build up in the entire pipe. The cleaning medium is conveyed out through this part of the screw-shaped slot and on through the nozzles 53, and due to the uniform pressure in the pipe, the cleaning effect of the cleaning medium will be equal throughout the extension of the jacket 43. Contrarily, if the cleaning medium were conveyed out through all nozzles 53 at the same time, a pressure reduction would soon arise along the nozzle pipe, the lowest pressure occurring opposite the end where the pressure is conveyed to the pipe. The nozzle pipe 41 of the present invention is thus subject to constant feeding of cleaning medium but the medium is only conveyed to a small area of the cylinder surface corresponding to the location along the extension of the nozzles 53 where the slot of the nozzle pipe overlaps the nozzles. During the rotation of the nozzle pipe, alternating parts of the slot will successively overlap the nozzles.

After the cleaning medium has loosened particles from the cylinder surface 16, these particles and any material deriving from the cleaning medium have to be removed from the cylinder. This is accomplished with the use of the suction pipe 42. Its function is structured in such a manner that cleaning is only effected on minor areas of the cylinder surface, said areas being exposed successively to a vacuum whereby the whole surface of the Cylinder is cleaned. The suction pipe 42 is in a constant vacuum from an external vacuum source. The area of the .cylinder surface being exposed to the vacuum will be the area positioned adjacent the location where part of the screw-shaped slot 55 in the suction pipe 42 overlaps the rectilinear slot in the jacket 43. This will only be a minor part of the total extension of the slot 54 in the jacket, and thus a strong suction capacity is obtained at this location. Contrarily, if the vacuum had been applied to the whole slot 54 in the jacket at the same time, the suction capacity would be very limited and the suction capacity in the end of the pipe opposite where the suction tube 47 is connected would be reduced. The suction pipe 42 of the present embodiment is thus able to suck off particles successively from adjacent areas of the cylinder surface due to the fact that the overlap of the screw-shaped slot 55 in the suction pipe 42 and the rectilinear slot 54 in the jacket 43 is transposed along the pipe member 40 during the rotation of the suction pipe.

The slot 54 in the jacket 43 of a preferred embodiment is designed so as to extend over a shorter distance than the slot 55 in the suction pipe 42. By this arrangement it is possible in a simple manner, without the use of valves, to cut off the vacuum from the suction pipe. If the suction pipe 42 is rotated to such an extent that the screw-shaped slot 55 in the pipe is moved away from the situation where the slot 55 is aligned with the slot 54 in the jacket 43, there will no longer be any connection between the inside of the suction pipe and the outside of the jacket, and the vacuum will be cut off. Likewise, the nozzles 53 in the jacket 43 extend over a shorter distance than the slot in the nozzle pipe 41. In the same manner as described above, it will thus be possible to turn off the flow of fluid from the nozzle pipe. In a preferred embodiment the mutual gearing between the nozzle pipe and the suction pipe is designed in such a manner that the flow of fluid from the nozzle pipe and the vacuum from the suction pipe are turned off simultaneously.

The figures show specific embodiments of apparatuses according to the invention for use by the method. However, the illustrated apparatuses should not be seen as a complete presentation of conceivable embodiments. Thus, other apparatus designs and other apparatus parts, which are all covered by the method and the apparatuses according to the invention, may be deduced. Besides, the method according to the invention may be used for other types of cylinders than cylinders provided with plates; and rollers and cylinders in machines other than printing machines may be cleaned by means of the method according to the invention.

I claim:

1. A method for automatic cleaning of a cylinder, especially a cylinder of a printing machine, said printing machine including a print plate, a print carrier, and a cleaning apparatus wherein a surface of the cylinder becomes smudged, during printing, with printing ink, particles detached from said print carrier, such as dust or fibers, and other foreign objects, said method comprising the steps of providing a cleaning apparatus having a mixing chamber and nozzles connected thereto providing a flow of pressurized fluid consisting of pressurized air and a liquid into the mixing chamber, introducing the pressurized fluid to the print plate through the nozzles connected with the mixing chamber, exposing an area of the cylinder surface to be cleaned to the pressurized fluid so that the particles inside the area on the cylinder surface are detached, and vacuuming said area to remove said detached particles and any other material deriving from said flow of pressurized fluid.

2. The method according to claim 1, wherein said flow of fluid is supplied with a granulated solid matter constituting a fluidized medium in said flow of fluid.

3. The method according to claim 1, wherein said flow of fluid is supplied to the print carrier through a slot-formed nozzle.

4. The method according to claim 1, wherein said flow of fluid is exposed to an ultrasonic action.

5. The method according to claim 1, wherein said detached particles are exposed to the electric voltage field, such that the particles are charged with static electricity, and that said area on the cylinder surface is brought in contact with the electric voltage field for assisting the removal of the detached particles from the cylinder surface.

6. The method according to claim 1, wherein said area of the cylinder surface is cleaned during operation of the printing machine, and successive cleaning is carried out on a multitude of areas of the cylinder surface in order to clean the entire cylinder.

7. An apparatus for automatic cleaning of a cylinder having a cylinder surface, said apparatus comprising a boom mounted adjacent to the cylinder, a cleaning head being mounted and conveyed on said boom, said cleaning head including an antechamber, a first orifice connected to the antechamber to supply a pressurized fluid onto the cylinder surface, a screen means provided over the first orifice, and a second orifice mounted in the immediate vicinity of the first orifice in an opposite direction of rotation of the cylinder to vacuum the cylinder surface, wherein the first orifice extends over a specific area of the cylinder surface, said area corresponding to the screen means, and at least two means for connecting the cleaning head respectively to a compressed-air system and a liquid reservoir.

8. The apparatus of claim 7, wherein the screen means includes a plurality of nozzles and said specific area corresponds to an accumulated length of the nozzles multiplied by an accumulated width of said nozzles.

9. The apparatus of claim 7, wherein the screen means includes an elongated slot, and said specific area corresponds to the length of the slot multiplied by the width of the slot.

10. The apparatus of claim 7, wherein the cleaning head is further connected to a solid matter reservoir.

11. An apparatus for cleaning a cylinder, comprising a first and second pipe connected respectively with a compressed-air source and a vacuum source, and a jacket on which said pipes are fixed, at least said first pipe comprising a slot extending according to a screw line along the pipe, and said jacket comprising a slot extending in a straight line along said jacket and being connected to an outer periphery of said first pipe, wherein said first pipe is connected to the compressed-air source, and also connected to a source of liquid such that a flow of pressurized air and liquid are mixed before being introduced into the interior of the first pipe.

12. The apparatus of claim 11, wherein said second pipe further comprises a slot extending according to a screw line along the pipe, said jacket comprising nozzles extending in a straight line along said jacket and being connected to the outer periphery of said second pipe, and said second pipe is connected to the vacuum source.

* * * * *